US008403441B2

(12) United States Patent
Tsubota et al.

(10) Patent No.: US 8,403,441 B2
(45) Date of Patent: Mar. 26, 2013

(54) LIQUID EJECTING APPARATUS AND CONTROL METHOD THEREOF FOR RESTORING AN EJECTION CAPABILITY

(75) Inventors: Shinichi Tsubota, Azumino (JP); Shuji Yonekubo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 176 days.

(21) Appl. No.: 12/914,078

(22) Filed: Oct. 28, 2010

(65) Prior Publication Data

US 2011/0109676 A1 May 12, 2011

(30) Foreign Application Priority Data

Nov. 12, 2009 (JP) ..... 2009-258825

(51) Int. Cl.
*B41J 29/38* (2006.01)

(52) U.S. Cl. ..... 347/11; 347/23; 347/27; 347/92

(58) Field of Classification Search ..... 347/9–11, 347/14, 19–20, 22–23, 27–30, 34–35
See application file for complete search history.

(56) References Cited

U.S. PATENT DOCUMENTS

| | | | | |
|---|---|---|---|---|
| 4,609,925 | A * | 9/1986 | Nozu et al. | 347/27 |
| 6,945,627 | B2 * | 9/2005 | Yamaguchi | 347/27 |
| 2009/0079773 | A1 | 3/2009 | Hosono et al. | |
| 2009/0295853 | A1 | 12/2009 | Hosono et al. | |
| 2009/0295854 | A1 | 12/2009 | Kawakami et al. | |

FOREIGN PATENT DOCUMENTS

| | | |
|---|---|---|
| JP | 2009-073074 | 4/2009 |
| JP | 2009-286074 | 12/2009 |
| JP | 2010-006048 | 1/2010 |

* cited by examiner

*Primary Examiner* — Juanita D Jackson
(74) *Attorney, Agent, or Firm* — Workman Nydegger

(57) ABSTRACT

A driving pulse for air bubble removal flushing which is a first maintenance pulse is a driving pulse which removes air bubbles in an ink flow path of a recording head, a driving pulse for thickened ink discharge flushing which is a second maintenance pulse is a driving pulse which removes thickened ink, thereby stabilizing a meniscus, and in a maintenance process which restores ejection capability of the recording head, after an air bubble removal flushing process is executed by using the driving pulse for air bubble removal flushing, a thickened ink discharge flushing process is executed by using the driving pulse for thickened ink discharge flushing.

4 Claims, 6 Drawing Sheets

LIQUID EJECTING APPARATUS AND CONTROL METHOD THEREOF FOR RESTORING AN EJECTION CAPABILITY

The entire disclosure of Japanese Patent Application No: 2009-258825, filed Nov. 12, 2009 are expressly incorporated by reference herein.

BACKGROUND

1. Technical Field

The present invention relates to a liquid ejecting apparatus such as an ink jet type printer and a control method thereof and in particular, to a liquid ejecting apparatus in which a maintenance process which restores ejection capability of a liquid ejecting head is performed, and a control method thereof.

2. Related Art

For example, a liquid ejecting apparatus is an apparatus which is provided with a liquid ejecting head capable of ejecting liquid from a nozzle and ejects a variety of liquids from the liquid ejecting head. As a representative example of the liquid ejecting apparatus, an image recording apparatus such as an ink jet type printer (hereinafter simply referred to as a printer) which is provided with an ink jet type recording head (hereinafter simply referred to as a recording head) as the liquid ejecting head and which performs the recording of an image or the like by ejecting and impacting ink in the form of liquid from the nozzle of the recording head onto a recording medium (an impacting target) such as a recording paper, can be given. Also, in recent years, the liquid ejecting apparatus has been applied not only to the image recording apparatus, but also to a variety of manufacturing apparatuses such as an apparatus for manufacturing a color filter of a liquid crystal display or the like.

Here, the above-mentioned printer is provided with the recording head which has a series of ink flow paths extending from a reservoir to the nozzle through a pressure chamber, a pressure generation section (for example, a piezoelectric element) for changing the volume of the pressure chamber, and the like, a driving signal generation section which generates a driving signal for driving the pressure generation section, and the like. Then, the printer is constituted so as to give rise to a pressure variation in the ink in the pressure chamber by applying a driving pulse which is included in the driving signal to the piezoelectric element and eject ink from the nozzle with use of the pressure variation. In such a printer, there is a case where the surface (meniscus) of ink exposed at the nozzle is exposed to the atmosphere, so that a solvent evaporates, thereby thickening the ink, or air bubbles are mixed into the pressure chamber or the like, so that a change in pressure is absorbed by the air bubbles, whereby poor ejection occurs such as non-ejection of ink (so-called dot omission) or curving of a flying direction of the ejected ink.

For this reason, in order to maintain excellent ejection of ink by preventing the above-mentioned poor ejection, techniques related to various maintenance processes have been proposed. For example, a cleaning process is performed which temporarily seals the nozzle by a cap, depressurizes the inside of the cap in the sealed state, and forcibly discharges thickened ink or air bubbles by performing idle ejection of ink by applying an ejection driving pulse to the piezoelectric element and thereby giving rise to a pressure variation in the ink in the pressure chamber. However, even if the above-mentioned cleaning process is executed, it is difficult to completely remove the air bubbles. In addition, the idle ejection is to eject ink for the purpose of restoring ejection characteristics of the recording head to a normal state, separately from ink ejection for the printing of an image or the like on the recording medium, which is the original purpose of the printer.

Therefore, in this type of printer, separately from the above-mentioned cleaning process, a maintenance process is performed which is called a flushing process which forcibly ejects ink from the nozzle. Specifically, after execution of the above-mentioned cleaning process or execution of initial filling at the time of exchange of an ink cartridge is performed, or for every predetermined printing unit during a printing operation (during a recording operation), for example, every time printing is performed for a constant period of time, every time the predetermined number of times of passes (scanning of the recording head) is performed, or every time the predetermined number of pages is printed, the recording head is moved up to an ink receiving member which is located at a position deviated from the recording medium and ink is repeatedly idle-ejected at the position. With respect to the flushing process, there is an air bubble removal flushing process mainly aimed to remove air bubbles in ink, or the like, other than a flushing process for thickened ink discharge, which idle-ejects ink for the main purpose of discharging ink thickened in the vicinity of the nozzle (for example, JP-A-2009-73074).

However, in the above-mentioned air bubble removal flushing process, if a change in pressure is increased so as to further increase an air bubble removal effect, residual vibration is also increased by a corresponding amount. If a process is moved to the print processing in a state where the residual vibration is not controlled, there is a concern that the weight or the flying speed of ink which is ejected will become unstable. For this reason, there is a problem that a time for attenuating the residual vibration needs to be set after the air bubble removal flushing process, so that it is not possible to transition quickly to the print processing.

Also, in an evaluation of the reliability of the above printer, an index which is called a MPBF (Mean Pages Between Failures) is sometimes used. The MPBF represents an average value of the number of pages of the recording papers which can be printed between adjacent breakdowns which are generated under use conditions prescribed in design within a period of the life-span of the printer as an apparatus (or between the first operation start after manufacturing of the printer and the first breakdown). That is, it can be said that the higher the value of the MPBF, the higher the reliability. Here, in the above-mentioned breakdown, poor ejection such as dot omission is included, and one of the causes of the poor ejection is air bubbles in a liquid flow path. Then, in a case where the printing operation is continuously performed in the above printer, minute air bubbles gradually accumulate in the liquid flow path of the recording head. For this reason, a flushing process is required in which it is possible to further increase air bubble discharging ability, thereby more reliably preventing the poor ejection, and moreover, it is possible to more quickly stabilize the meniscus after the maintenance process.

SUMMARY

An advantage of some aspects of the invention is that it provides a liquid ejecting apparatus in which it is possible to improve the MPBF by improving a discharge effect of thickened liquid or minute air bubbles in a liquid flow path of a liquid ejecting head and moreover, it is possible to shorten the time required for a maintenance process, and a control method thereof.

According to a first aspect of the invention, there is provided a liquid ejecting apparatus including: a liquid ejecting head which can eject liquid from a nozzle by driving a pressure generation section which changes the volume of a pressure chamber which communicates with the nozzle; and a control unit which generates a driving signal that includes a driving pulse that drives the pressure generation section, and applies the driving signal to the pressure generation section, thereby controlling the ejection of the liquid, wherein the control unit is constituted so as to be able to generate a first maintenance pulse and a second maintenance pulse, the first maintenance pulse is a driving pulse for removing air bubbles in a liquid flow path of the liquid ejecting head, the second maintenance pulse is a driving pulse for removing thickened liquid, thereby stabilizing a meniscus, and the control unit executes a second maintenance process by using the second maintenance pulse, after execution of a first maintenance process with use of the first maintenance pulse, in a maintenance process which restores ejection capability of the liquid ejecting head.

Also, according to a second aspect of the invention, there is provided a liquid ejecting apparatus including: a liquid ejecting head which can eject liquid from a nozzle by driving a pressure generation section which changes the volume of a pressure chamber which communicates with the nozzle; and a control unit which generates a driving signal that includes a driving pulse that drives the pressure generation section, and applies the driving signal to the pressure generation section, thereby controlling the ejection of the liquid, wherein the control unit is constituted so as to be able to generate a first maintenance pulse and a second maintenance pulse, the first maintenance pulse is set such that a change in pressure which occurs in the liquid in the pressure chamber by driving the pressure generation section becomes larger in comparison with the second maintenance pulse, and the control unit executes a second maintenance process by using the second maintenance pulse, after execution of a first maintenance process with use of the first maintenance pulse, in a maintenance process which restores ejection capability of the liquid ejecting head.

Further, according to a third aspect of the invention, there is provided a liquid ejecting apparatus including: a liquid ejecting head which can eject liquid from a nozzle by driving a pressure generation section which changes the volume of a pressure chamber which communicates with the nozzle; and a control unit which generates a driving signal that includes a driving pulse that drives the pressure generation section, and applies the driving signal to the pressure generation section, thereby controlling the ejection of the liquid, wherein the control unit is constituted so as to be able to generate a first maintenance pulse and a second maintenance pulse, the first maintenance pulse is composed of a series of waveform elements for giving rise to a change in pressure within the pressure chamber so as to remove air bubbles in a liquid flow path of the liquid ejecting head, the second maintenance pulse includes an ejection portion which is composed of waveform elements for ejecting liquid from the nozzle, and a vibration suppression portion which is composed of waveform elements for suppressing a residual vibration of a meniscus after the ejection of liquid by the ejection portion, the control unit executes a second maintenance process by using the second maintenance pulse, after execution of a first maintenance process with use of the first maintenance pulse, in a maintenance process which restores ejection capability of the liquid ejecting head.

According to the above aspects of the invention, in the maintenance process, after execution of the first maintenance process, by performing the second maintenance process in combination, it is possible to more efficiently remove thickened liquid or air bubbles in the liquid flow path in comparison with the case of performing each maintenance process alone. Consequently, it is possible to improve the MPBF, and moreover, it becomes possible to shorten the time required for the maintenance process. In addition, since a residual vibration of a meniscus is stabilized at the point of time when a thickened ink removal flushing process has ended, it is possible to shorten a waiting time for controlling the residual vibration, so that it is possible to further shorten the time required for the maintenance process.

In addition, in the above aspects, a configuration may also be adopted in which the control unit executes the maintenance process every time a liquid ejection operation is performed by a predetermined unit with respect to a recording medium as an impacting target which is a target on which the liquid ejection operation is performed, and the second maintenance pulse in the maintenance process is a pulse for thickened liquid discharge for discharging thickened liquid from the nozzle.

Further, in the above aspects, a configuration may also be adopted in which the control unit executes the maintenance process every time a recording medium as an impacting target which is a target on which a liquid ejection operation is performed is supplied to the top of a stage which faces a nozzle face of the liquid ejecting head and every time the recording medium is discharged from the stage, and the second maintenance pulse in the maintenance process is a pulse for film breakage for breaking a meniscus changed into the form of a film by thickening.

Also, according to a fourth aspect of the invention, there is provided a control method of a liquid ejecting apparatus which includes a liquid ejecting head that can eject liquid from a nozzle by driving a pressure generation section which changes the volume of a pressure chamber which communicates with the nozzle; and a control unit which generates a driving signal that includes a driving pulse that drives the pressure generation section, and applies the driving signal to the pressure generation section, thereby controlling the ejection of the liquid, wherein the control unit is constituted so as to be able to generate a first maintenance pulse and a second maintenance pulse, the first maintenance pulse is a driving pulse for removing air bubbles in a liquid flow path of the liquid ejecting head, and the second maintenance pulse is a driving pulse for removing thickened liquid, thereby stabilizing a meniscus, the method including: executing a second maintenance process by using the second maintenance pulse, after execution of a first maintenance process with use of the first maintenance pulse, in a maintenance process which restores ejection capability of the liquid ejecting head.

Further, according to a fifth aspect of the invention, there is provided a control method of a liquid ejecting apparatus which includes a liquid ejecting head that can eject liquid from a nozzle by driving a pressure generation section which changes the volume of a pressure chamber which communicates with the nozzle; and a control unit which generates a driving signal that includes a driving pulse that drives the pressure generation section, and applies the driving signal to the pressure generation section, thereby controlling the ejection of the liquid, wherein the control unit is constituted so as to be able to generate a first maintenance pulse and a second maintenance pulse, and the first maintenance pulse is set such that a change in pressure which occurs in the liquid in the pressure chamber by driving the pressure generation section becomes larger in comparison with the second maintenance pulse, the method including: executing a second maintenance process by using the second maintenance pulse, after execution of a first maintenance process with use of the first maintenance pulse, in the case of executing a maintenance process which restores ejection capability of the liquid ejecting head.

Also, according to a sixth aspect of the invention, there is provided a control method of a liquid ejecting apparatus which includes a liquid ejecting head that can eject liquid from a nozzle by driving a pressure generation section which changes the volume of a pressure chamber which communicates with the nozzle; and a control unit which generates a driving signal that includes a driving pulse that drives the pressure generation section, and applies the driving signal to the pressure generation section, thereby controlling the ejection of the liquid, wherein the control unit is constituted so as to be able to generate a first maintenance pulse and a second maintenance pulse, the first maintenance pulse is composed of a series of waveform elements for giving rise to a change in pressure within the pressure chamber so as to remove air bubbles in a liquid flow path of the liquid ejecting head, and the second maintenance pulse includes an ejection portion which is composed of waveform elements for ejecting liquid from the nozzle, and a vibration suppression portion which is composed of waveform elements for suppressing a residual vibration of a meniscus after the ejection of liquid by the ejection portion, the method including: executing a second maintenance process by using the second maintenance pulse, after execution of a first maintenance process with use of the first maintenance pulse, in the case of executing a maintenance process which restores ejection capability of the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described with reference to the accompanying drawings. In addition, in the embodiments described below, a variety of limitations are given as the preferred specific examples of the invention. However, unless the description of intent to limit the invention is particularly given in the following explanation, the scope of the invention is not to be limited to these aspects. Also, in the following, an ink jet type recording apparatus (hereinafter referred to as a printer) is taken and explained as an example of a liquid ejecting apparatus of the invention.

Figure 1:
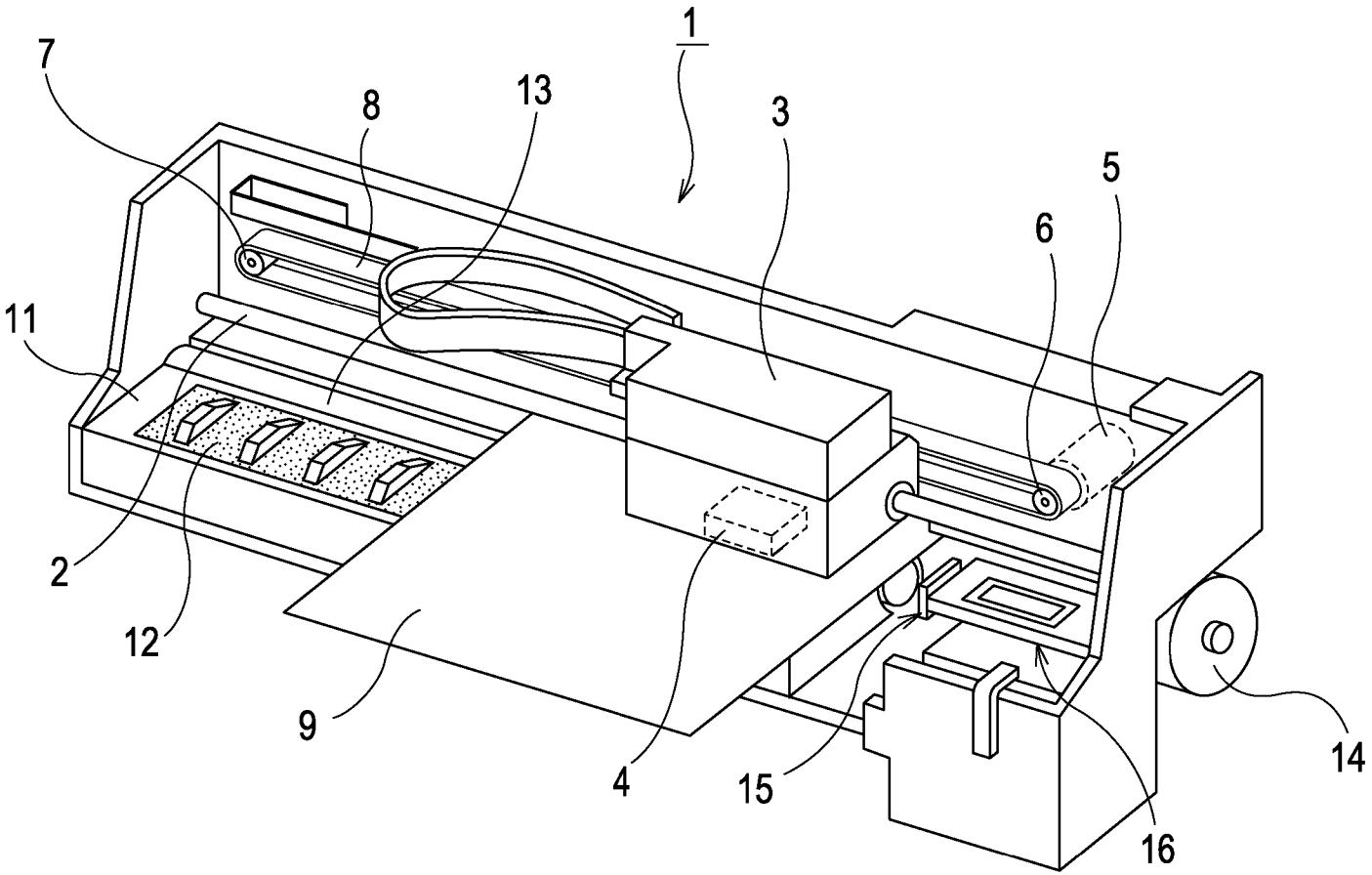
FIG. 1 is a perspective view explaining the configuration of a printer.

FIG. 1 is a perspective view explaining the basic configuration of a printer 1. As shown in FIG. 1, the printer 1 has a carriage 3 mounted on a guide shaft 2, and a recording head 4 (one type of a liquid ejecting head in the invention) is mounted on the lower surface of the carriage. Also, in the inside of the carriage 3, a cartridge holder section which detachably holds an ink cartridge is provided (neither of these members is shown). Then, the carriage 3 is connected to a timing belt 8 mounted so as to pass around and extend between a driving pulley 6 joined to a rotary shaft of a carriage motor 5 and an idling pulley 7 and moves in the width direction of a recording paper 9 (in a main scanning direction) by the driving of the carriage motor 5. That is, a carriage movement mechanism 51 (refer to FIG. 3) is constituted by the carriage motor 5, the driving pulley 6, the idling pulley 7, and the timing belt 8.

The ink cartridge is a storage member which stores ink (one type of liquid in the invention). The ink is ink in which a color material is dissolved or dispersed in an ink solvent. For example, pigment or dye is used as the color material and water is used as the ink solvent. Then, if the ink cartridge is mounted on the cartridge holder section, an ink supply needle (not shown) provided at the cartridge holder section is inserted into the ink cartridge. Since the ink supply needle is communicated with an ink flow path (one type of a liquid flow path) of the recording head 4, if the ink supply needle is inserted, a state is made where ink in the ink cartridge can be supplied into the recording head 4. In addition, as the ink cartridge, it is also possible to adopt a type which is disposed on the printer main body (casing) side, thereby supplying ink to the recording head 4 through an ink supply tube.

Also, a platen 11 is provided below the guide shaft 2. The platen 11 is a plate-like member which supports the recording paper 9 from below. At the platen 11, a liquid absorption member 12 such as a sponge is disposed. Also, further on the upstream side in a paper feed direction than the liquid absorption member 12, a paper feed roller 13 is disposed in parallel to the guide shaft 2. The paper feed roller 13 is rotated by a driving force from a paper feed motor 14 at the time of transport of the recording paper 9. That is, a paper feed mechanism 52 (refer to FIG. 3) is constituted by the paper feed roller 13 and the paper feed motor 14.

A home position is set within a movement range of the carriage 3 at a position further outside than the platen 11. The recording head 4 is positioned at the home position in a waiting state. At the home position, a wiper mechanism 15 for wiping a nozzle formation surface of the recording head 4 and a capping mechanism 16 capable of sealing the nozzle formation surface in a non-recording state are disposed side by side along the guide shaft 2.

Figure 2:
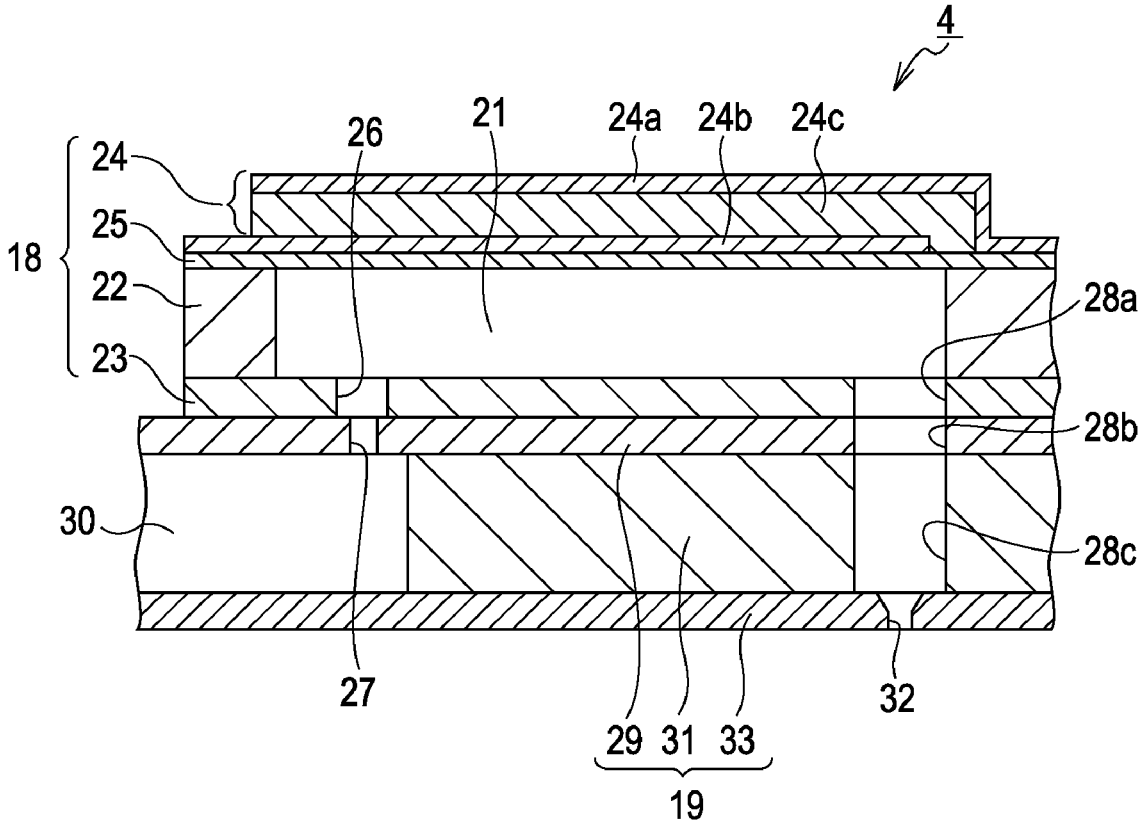
FIG. 2 is a partial cross-sectional view of a recording head.

As shown in FIG. 2, the recording head 4 is constituted by a pressure generation unit 18 and a flow path unit 19 and integrated in a state where these units are superposed. The pressure generation unit 18 is constituted by stacking a pressure chamber plate 22 for partitioning pressure chambers 21, a communicating opening plate 23 in which a supply-side communicating opening 26 and a first communicating opening 28*a* are opened, and a vibration plate 25 on which a piezoelectric element 24 is mounted, and integrating these plates by firing or the like. Also, the flow path unit 19 is constituted by bonding plate members which include a supply opening plate 29 in which a supply opening 27 or a second communicating opening 28*b* is formed, a reservoir plate 31 in which a reservoir 30 or a third communicating opening 28*c* is formed, and a nozzle plate 33 in which a nozzle 32 is formed, in a stacked state.

On the outer surface of the vibration plate 25 which is the opposite side to the pressure chamber 21, a plurality of piezoelectric elements 24 is disposed in a state where they respectively correspond to the respective pressure chambers 21. The piezoelectric element 24 illustrated is a vibrator of a flexural vibration mode and is constituted by interposing a piezoelectric body 24*c* between a driving electrode 24*a* and a common electrode 24*b*. Then, if a driving signal (a driving pulse) is applied to the driving electrode of the piezoelectric element 24, an electric field corresponding to an electric potential difference is generated between the driving electrode 24*a* and the common electrode 24*b*. The electric field is applied to the piezoelectric body 24*c*, so that the piezoelectric body 24*c* is deformed in accordance with the intensity of the applied electric field. That is, as an electric potential of the driving electrode 24*a* becomes higher, the piezoelectric body layer 24*c* contracts in the direction perpendicular to the electric field, thereby deforming the vibration plate 25 so as to reduce the volume of the pressure chamber 21.

Figure 3:
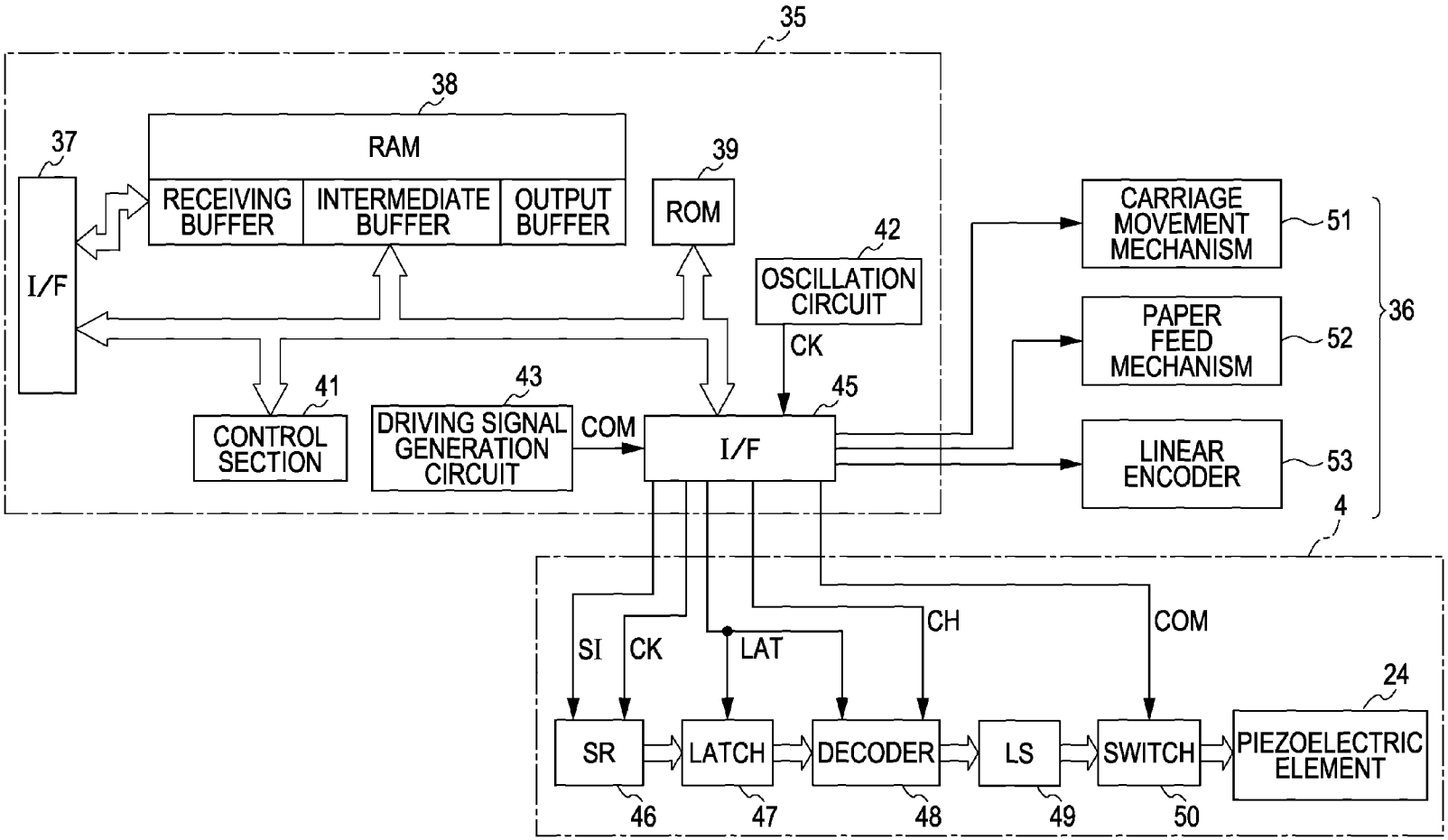
FIG. 3 is a block diagram explaining the electrical configuration of the printer.

FIG. 3 is a block diagram showing the electrical configuration of the printer 1. The printer 1 is generally constituted by a printer controller 35 and a print engine 36. The printer controller 35 is equivalent to a control unit in the invention and generates a driving signal which includes a driving pulse for driving the piezoelectric element 24 of the recording head 4, thereby deforming and driving the piezoelectric element 24 in accordance with a change in electric potential of the driving pulse. The printer controller 35 includes an external interface (external I/F) 37, to which print data or the like from an external apparatus such as a host computer is input, a RAM 38 which stores various data and the like, a ROM 39 in which a control routine or the like for various data processing is stored, a control section 41 which performs the control of each section, an oscillation circuit 42 which generates a clock signal, a driving signal generation circuit 43 which generates a driving signal which is supplied to the recording head 4, and an internal interface (internal I/F) 45 for outputting pixel data which is obtained by expanding the print data for each dot, the driving signal, or the like to the recording head 4.

The control section 41 outputs a head control signal for controlling an operation of the recording head 4 to the recording head 4 or outputs a control signal for generating the driving signal to the driving signal generation circuit 43. The control section 41 also functions as a timing pulse generation section which generates a timing pulse PTS from an encoder pulse EP which is output from a linear encoder 53 in accordance with a scanning position of the recording head 4. The timing pulse PTS is a signal which prescribes a generation start timing of the driving signal that the driving signal generation circuit 43 generates. The driving signal generation circuit 43 outputs the driving signal every time the driving signal generation circuit receives the timing pulse PTS. In other words, the driving signal is repeatedly generated with a unit period which is separated by the timing pulse PTS. Also, in synchronization with the timing pulse PTS, the control section 41 outputs a latch signal LAT or a change (channel) signal CH to the recording head 4. The latch signal LAT is a signal which prescribes a start timing of a unit period T of the driving signal, and the change signal CH prescribes a supply start timing of the driving pulse which is included in the driving signal.

The driving signal generation circuit 43 generates a driving signal which includes a driving pulse for recording an image or the like by ejecting ink onto a recording medium (an impacting target) such as the recording paper 9. Also, the driving signal generation circuit 43 in this embodiment is constituted so as to be able to generate a plurality of driving signals for maintenance, which includes a maintenance pulse. The details of a maintenance process using the driving signal for maintenance will be described later.

Next, the configuration of the print engine 36 side will be explained. The print engine 36 is constituted by the recording head 4, the carriage movement mechanism 51, the paper feed mechanism 52, and the linear encoder 53. The recording head 4 is provided with a shift register (SR) 46, a latch 47, a decoder 48, a level shifter (LS) 49, a switch 50, and the piezoelectric element 24, each of which is provided in a plurality of numbers corresponding to the respective nozzle 32. A unit of pixel data (SI) from the printer controller 35 is serial-transmitted to the shift register 46 in synchronization with the clock signal (CK) from the oscillation circuit 42.

The latch 47 is electrically connected to the shift register 46, and if the latch signal (LAT) from the printer controller 35 is input to the latch 47, the latch latches the pixel data of the shift register 46. The pixel data latched by the latch 47 is input to the decoder 48. The decoder 48 interprets 2-bit pixel data, thereby generating pulse selection data. The pulse selection data in this embodiment is constituted by a total of two bits of data.

Then, the decoder 48 outputs the pulse selection data to the level shifter 49 with the receipt of the latch signal (LAT) or the change signal (CH) as a trigger. In this case, the pulse selection data is input to the level shifter 49 in sequence from a higher-order bit. The level shifter 49 functions as a voltage amplifier and outputs an electric signal boosted to a voltage capable of driving the switch 50, for example, a voltage in the order of several tens of volts, in a case where the pulse selection data is "1". The pulse selection data of "1" boosted by the level shifter 49 is supplied to the switch 50. To the input side of the switch 50, a driving signal COM from the driving signal generation circuit 43 is supplied, and to the output side of the switch 50, the piezoelectric element 24 is connected.

Then, the pulse selection data controls an operation of the switch 50, that is, the supply of the driving pulse in the driving signal to the piezoelectric element 24. For example, during a period in which the pulse selection data which is input to the switch 50 is "1", the switch 50 enters a connected state, so that a corresponding driving pulse is supplied to the piezoelectric element 24, and an electric potential level of the piezoelectric element 24 varies in accordance with a waveform of the driving pulse. On the other hand, during a period in which the pulse selection data is "0", an electric signal for operating the switch 50 is not output from the level shifter 49. Therefore, the switch 50 enters a disconnected state, so that the driving pulse is not supplied to the piezoelectric element 24.

Next, the maintenance process for restoring ejection capability of the recording head 4 in the above-described configuration will be explained.

In this type of the printer, since the nozzle is exposed to the atmosphere during a print processing, the solvent of the ink evaporates from the nozzle, so that the viscosity of the ink in the vicinity of the nozzle increases. If the viscosity of the ink increases, there is a concern that poor ejection will occur such as a reduction in the amount (weight or volume) of ink which is ejected from the nozzle, generation of a curved flight due to the lowering of the flying speed of the ejected ink, or generation of so-called dot omission in which ink is not ejected from the nozzle, in the worst case. Also, in this type of printer, at the time of the initial filling of the ink flow path of the recording head with ink in a newly-mounted ink cartridge, or the like, there is a case where air (air bubbles) is mixed into ink. Then, air is gradually dissolved in ink as time passes from the ink filling and eventually a saturation state is created. Ink in which air is dissolved in the saturation state in this manner is called saturated ink. In such saturated ink, since solubility is lowered with increase in temperature, if ink is continuously ejected from the nozzle during the print processing, so that a pressure variation is repeated or the temperature of the ink rises, air dissolved in ink appears as air bubbles and the air bubbles accumulate in the ink flow path. The air bubbles retained in the ink flow path sometimes block the ink flow path or absorb a change in pressure at the time of ink ejection. As a result, there is a concern that the above-mentioned poor ejection will occur.

Therefore, in the printer 1 according to the invention, in order to restore the recording head 4 to a normal state, that is, a state where ejection of ink from the nozzle 32 is appropriately performed by preventing poor ejection, the maintenance process is performed. In the maintenance process, air bubbles or the thickened ink is discharged along with ink by applying a maintenance pulse, which will be described later, to the piezoelectric element 24, thereby idle-ejecting ink from the nozzle 32, separately from the print processing which ejects ink for the purpose of the printing of an image or the like onto the recording medium. In this embodiment, there are two processes, a case (a periodic maintenance process) where during the print processing, the print processing is temporarily interrupted for every constant process unit and then the maintenance process is executed, and a case where a maintenance process (a paper feed and discharge maintenance process) is executed every time the recording medium such as the recording paper 9 is supplied onto the platen 11 which is a stage that faces a nozzle face (the nozzle plate 33) of the recording head 4 and every time the recording medium is discharged from the platen 11.

Figure 4:
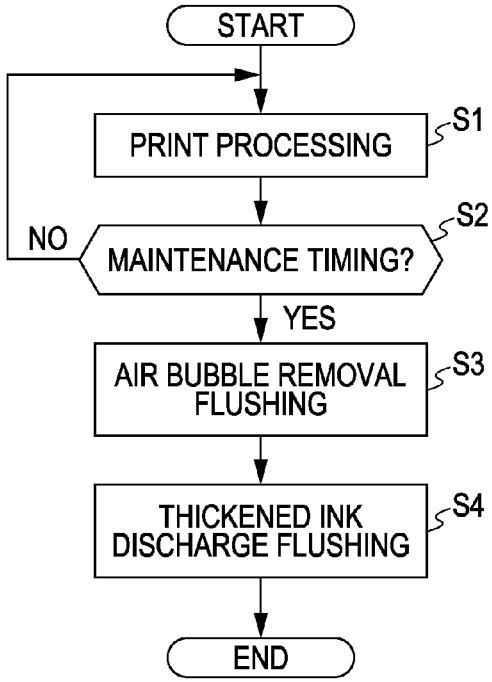
FIG. 4 is a flowchart explaining the flow of a periodic maintenance process.

FIG. 4 is a flowchart explaining the flow of the periodic maintenance process.

The periodic maintenance process is a restoration process which is executed during the print processing, as described above. The printer controller 35 which functions as the control unit during the print processing (S1) determines whether or not maintenance is scheduled (S2). With respect to the maintenance timing, a decision is made, for example, whether or not any of the elapsed time from the point of time when the print processing has been started or the point of time when the last periodic maintenance process has been executed in the running print processing, the number of print pages of the recording medium (the recording paper 9), or the number of times of scanning (pass) of the recording head 4 has reached a set value. That is, the set value is equivalent to a process unit.

In Step S2, if it is determined that the time for maintenance timing has arrived, the printer controller 35 controls the carriage movement mechanism 51, thereby moving the recording head 4 up to the top of the capping mechanism 16 or the top of a flushing point set at an end portion area of the platen 11. In the periodic maintenance process in this embodiment, two kinds of maintenance processes (flushing processes) are continuously executed in this state. First, an air bubble removal flushing process (equivalent to a first maintenance process) with an aim of removing air bubbles mainly in the ink flow path is executed (S3). In the air bubble removal flushing process, by applying a pressure variation stronger than that at the time of the print processing or the time of another flushing process to ink in the pressure chamber 21 by continuously applying a driving pulse for air bubble removal flushing (one type of a first maintenance pulse) to the piezoelectric element 24, flushing which forcibly idle-ejects ink from the nozzles 32 to the flushing point such as a cap member of the capping mechanism 16 is performed, whereby air bubbles in the ink flow path are discharged along with ink.

Figure 5:
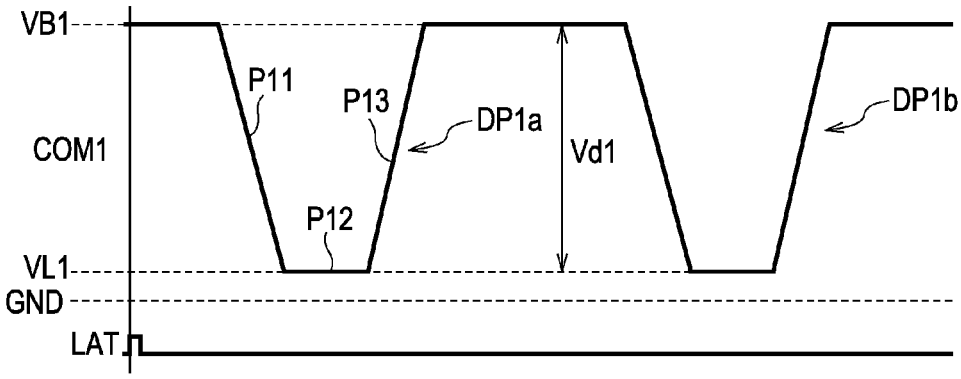
FIG. 5 is a diagram explaining a driving signal for air bubble removal flushing.

FIG. 5 is a diagram explaining a driving signal for air bubble removal flushing, COM1, which is used in the air bubble removal flushing process. The driving signal COM1 is constituted including two driving pulses for air bubble removal flushing, DP1 (DP1*a* and DP1*b*), within a unit period which is separated by a timing signal (LAT). A first reference electric potential (an electric potential which becomes a reference of a change in electric potential of the driving pulse) VB1 of the driving signal is adjusted to an electric potential (a contraction electric potential) which corresponds to a state where the piezoelectric element 24 has been displaced to the pressure chamber 21 side to the maximum extent in the range in which displacement is possible, so that the pressure chamber 21 has contracted. Also, a first expansion electric potential VL1 is an electric potential (an expansion electric potential) which corresponds to a state where the piezoelectric element 24 has been displaced to the side opposite to the pressure chamber 21 to the maximum extent in the range in which displacement is possible, so that the pressure chamber 21 has expanded.

The driving pulse for air bubble removal flushing, DP1, is a driving pulse set such that a pressure variation which occurs in the pressure chamber 21 at the time of the driving of the piezoelectric element 24 becomes larger in comparison with a driving pulse for another flushing which will be described later. Through this driving pulse, it is possible to more reliably apply a change in pressure to air bubbles in the ink flow path, so that air bubble discharging ability is further increased. The driving pulse for air bubble removal flushing, DP1, is composed of an expansion element P11, in which an electric potential is changed to the minus side (in a first direction) from the first reference electric potential VB1 (the expansion electric potential) up to the first expansion electric potential VL1, thereby expanding the pressure chamber 21, an expansion maintaining element P12 (a holding element) which maintains the first expansion electric potential VL1 for a certain period of time, and a contraction element P13, in which the electric potential is changed to the plus side (in a second direction) from the first expansion electric potential VL1 up to the first reference electric potential VB1, thereby rapidly contracting the pressure chamber 21. That is, the driving pulse for air bubble removal flushing, DP1, is composed of a series of waveform elements for giving rise to a change in pressure within the pressure chamber 21 so as to merge the air bubbles in the ink flow path into ink.

If the driving pulse for air bubble removal flushing, DP1, is applied to the piezoelectric element 24, first, the piezoelectric element 24 is bent in a direction away from the pressure chamber 21 by the expansion element P11, so that the pressure chamber 21 expands from a contracted volume corresponding to the first reference electric potential VB1 up to an expanded volume corresponding to the first expansion electric potential VL1. In accordance with the expansion, the meniscus in the nozzle 32 is sucked significantly to the pressure chamber 21 side. Then, the expanded state of the pressure chamber 21 is maintained over a supply period of the expansion maintaining element P12. Thereafter, the contraction element P13 is applied, so that the piezoelectric element 24 is bent to the pressure chamber 21 side. Due to the displacement of the piezoelectric element 24, the pressure chamber 21 rapidly contracts from the expanded volume up to the contracted volume. Ink in the pressure chamber 21 is pressurized due to the rapid contraction of the pressure chamber 21, so that ink is ejected from the nozzle 32. Both the amount and the flying speed of ink which is ejected from the nozzle 32 in the air bubble removal flushing process are large in comparison with the case of the print processing or the case of another flushing process.

In the air bubble removal flushing process, the printer controller 35 repeatedly applies the driving pulse for air bubble removal flushing, DP1, which is generated from the driving signal generation circuit 43, to the piezoelectric element 24, thereby continuously executing the preset number of times of ink idle ejection with respect to each nozzle 32. The continuous idle ejection is called a continuous flushing segment. In addition, an applied frequency (a driving frequency) of the driving pulse for air bubble removal flushing, DP1, to the piezoelectric element 24 is set to be about 2 kHz, for example. Then, a change in pressure, which is relatively large (large in comparison with a change in pressure at the time of ejection in the print processing or a change in pressure at the time of ejection in another flushing process), acts on the air bubbles retained in the ink flow path through the air bubble removal flushing process. By repeating such a strong change in pressure, merging of the air bubbles in the ink flow path into ink is promoted. As a result, it is possible to discharge the air bubbles retained in the ink flow path from the nozzle 32 along with ink.

If the air bubble removal flushing process executes only a predetermined flushing segment, subsequently, a thickened ink discharge flushing process aimed to discharge ink thickened mainly in the vicinity of the nozzle 32 is executed (S4). In the thickened ink discharge flushing process, for example, an ejection pulse in which the largest amount of ink is ejecting in the print processing, for example, an ejection pulse for a large dot is continuously applied as a driving pulse for thickened ink discharge flushing (one type of a second maintenance pulse) to the piezoelectric element 24, so that flushing which forcibly idle-ejects ink from the nozzle 32 to a flushing point is executed. As a result, the thickened ink in the ink flow path is discharged.

Figure 6:
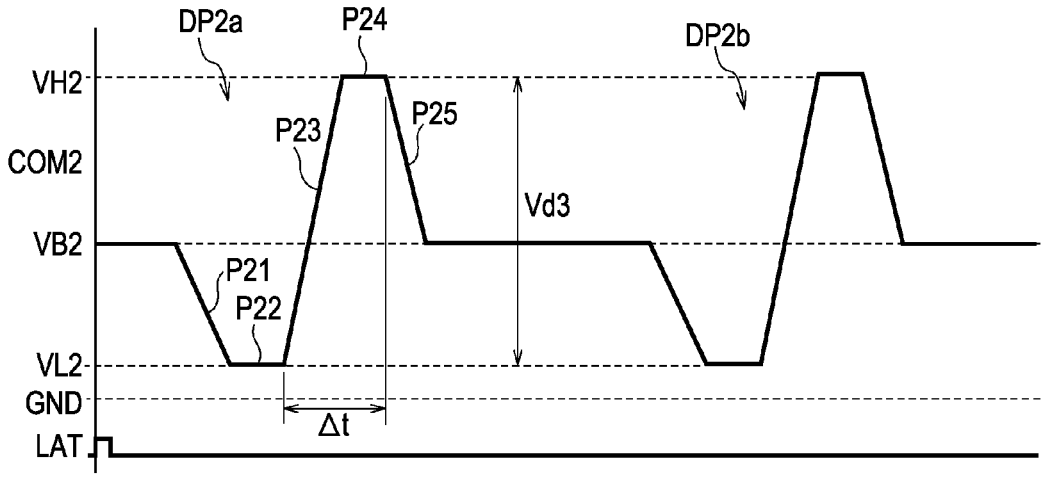
FIG. 6 is a diagram explaining a driving signal for thickened ink discharge flushing.

FIG. 6 is a diagram explaining a driving signal for thickened ink discharge flushing, COM2, which is used in the thickened ink discharge flushing process. The driving signal COM2 is constituted to include two driving pulses for thickened ink discharge flushing, DP2 (DP2*a* and DP2*b*), within a unit period which is separated by the LAT signal. A second reference electric potential VB2 of the driving signal is adjusted to be around 50% of an electric potential (a second contraction electric potential VH2) which corresponds to a state where the piezoelectric element 24 has been displaced to the pressure chamber 21 side, so that the pressure chamber 21 has contracted. In addition, a second expansion electric potential VL2 is an electric potential which corresponds to a state where the piezoelectric element 24 has been displaced to the side opposite to the pressure chamber 21, so that the pressure chamber 21 has expanded.

The driving pulse for thickened ink discharge flushing, DP2, (one type of a pulse for thickened liquid discharge) is the ejection pulse for a large dot which is used in the print processing, as described above, and is constituted such that it is possible to discharge ink stably in comparison with the flushing pulse for air bubble removal, DP1. The driving pulse for thickened ink discharge flushing, DP2, is composed of an expansion element P21, in which an electric potential is changed to the minus side (in the first direction) from the second reference electric potential VB2 up to the second expansion electric potential VL2, thereby expanding the pressure chamber 21, an expansion maintaining element P22 (a holding element) which maintains the second expansion electric potential VL2 for a certain period of time, a contraction element P23, in which the electric potential is changed to the plus side (in the second direction) from the second expansion electric potential VL2 up to the second contraction electric potential VH2, thereby rapidly contracting the pressure chamber 21, a contraction maintaining element P24 (a vibration suppression and holding element) which maintains the second contraction electric potential VH2 for a certain period of time, and a return element P25, in which the electric potential returns from the second contraction electric potential VH2 up to the second reference electric potential VB2. In other words, the driving pulse for thickened ink discharge flushing, DP2, is constituted by an ejection portion which is composed of waveform elements (the expansion element P21 to the contraction element P23) for ejecting ink from the nozzle 32 and a vibration suppression portion which is composed of waveform elements (the contraction maintaining element P24 and the return element P25) for suppressing and stabilizing residual vibration of the meniscus after ejection of ink by the ejection portion.

A time Δt from the beginning of the contraction element P23 of the driving pulse for thickened ink discharge flushing, DP2, to the beginning of the return element P25 is adjusted to be a value which is applied to the piezoelectric element 24 by the return element P25 at a timing which cancels out residual vibration occurring within the pressure chamber 21 in accordance with an ink ejection operation by the contraction element P23. Specifically, the interval Δt is set to be n·Tc/2 (n: an integer). Here, Tc is a natural vibration period (Helmholtz resonance period) which occurs at ink in the pressure chamber 21. The natural vibration period Tc is individually determined at the recording heads in accordance with a dimension or the like of the ink flow path in the head which includes the pressure chamber 21. Therefore, even in the recording heads of the same type, the natural vibration periods Tc are different from each other, so that the interval Δt is also individually set to be a value based on the Tc for every recording head.

In addition, the natural vibration period Tc can be expressed by, for example, the following equation 1.

$$Tc=2\pi\sqrt{[\{(Mn\times Ms)/(Mn+Ms)\}\times Cc]} \quad (1)$$

In the equation 1, Mn is an inertance in the nozzle 32, Ms is an inertance in the supply-side communicating opening 26 and the supply opening 27, and Cc is compliance (it represents a volumetric change per unit pressure, that is, the degree of softness) of the pressure chamber 21.

In the above equation 1, an inertance M represents ease of movement of ink in the ink flow path and is mass of ink per unit cross-sectional area. Then, when the density of ink is ρ, a cross-sectional area of the surface perpendicular to an ink flow direction in the flow path is S, and a length of the flow path is L, the inertance M can be approximately expressed by the following equation 2.

$$\text{Inertance } M=(\text{density } \rho\times\text{length } L)/\text{cross-sectional area } S \quad (2)$$

Also, it is not limited to the natural vibration period of the equation 1, but a vibration period which the pressure chamber 21 has may also be used.

If the driving pulse for thickened ink discharge flushing, DP2, is applied to the piezoelectric element 24, first, the piezoelectric element 24 is bent in a direction away from the pressure chamber 21 by the expansion element P21, so that the pressure chamber 21 expands from a reference volume corresponding to the second reference electric potential VB2 up to an expanded volume corresponding to the second expansion electric potential VL2. Through this expansion, the meniscus in the nozzle 32 is greatly drawn to the pressure chamber 21 side. Then, the expanded state of the pressure chamber 21 is maintained over a supply period of the expansion maintaining element P22. Thereafter, the contraction element P23 is applied, so that the piezoelectric element 24 is bent to the pressure chamber 21 side. Due to the displacement of the piezoelectric element 24, the pressure chamber 21 rapidly contracts from the expanded volume up to the contracted volume. Ink in the pressure chamber 21 is pressurized due to the rapid contraction of the pressure chamber 21, so that ink is ejected from the nozzle 32. The contracted state of the pressure chamber 21 is maintained over a supply period of the contraction maintaining element P24. Then, the return element P25 is applied, so that the piezoelectric element 24 is bent in a direction away from the pressure chamber 21, whereby the pressure chamber 21 returns from the contracted volume up to the reference volume. As a result, a pressure oscillation which is different in phase from (preferably, has the opposite phase to) the residual vibration occurs, so that the residual vibration is reduced.

In the thickened ink discharge flushing process, the printer controller 35 repeatedly applies the flushing driving pulse for thickened ink discharge, DP2, which is generated from the driving signal generation circuit 43, to the piezoelectric element 24 by the prescribed flushing segment, thereby continuously executing the predetermined number of times of idle ejection of ink with respect to each nozzle 32. By performing such a thickened ink discharge flushing process, the thickened ink is discharged from the nozzle 32, so that an ejection obstacle due to an increase in viscosity of ink is prevented beforehand. The amount of ink which is ejected in the thickened ink discharge flushing process is slightly less than the amount of ink which is ejected in the above-mentioned air bubble removal flushing process and more than the amount of ink which is ejected in a film breakage flushing process which will be described later. Also, the flying speed of ink which is ejected in the thickened ink discharge flushing process is slower than the case of the above-mentioned air bubble removal flushing process and the case of the film breakage flushing process described later. Also, in the thickened ink discharge flushing process, since the vibration suppression portion is provided at the flushing driving pulse for thickened ink discharge, DP2, it is possible to quickly attenuate the residual vibration which occurs in the flushing process, thereby stabilizing the meniscus.

In this manner, in the printer 1 according to the invention, after the air bubble removal flushing process which is the first maintenance process, by performing in combination the thickened ink discharge flushing process which is a second maintenance process, it is possible to more efficiently remove the thickened ink or the air bubbles in the ink flow path in comparison with a case where each flushing process is performed alone. As a result, it is possible to improve the MPBF, and moreover, it becomes possible to shorten the time required for the maintenance process. In addition, since the residual vibration is suppressed at the point of time when the thickened ink discharge flushing process has ended, it is possible to shorten a waiting time for controlling the residual vibration, so that it is possible to quickly transition to the next print processing.

Figure 8:
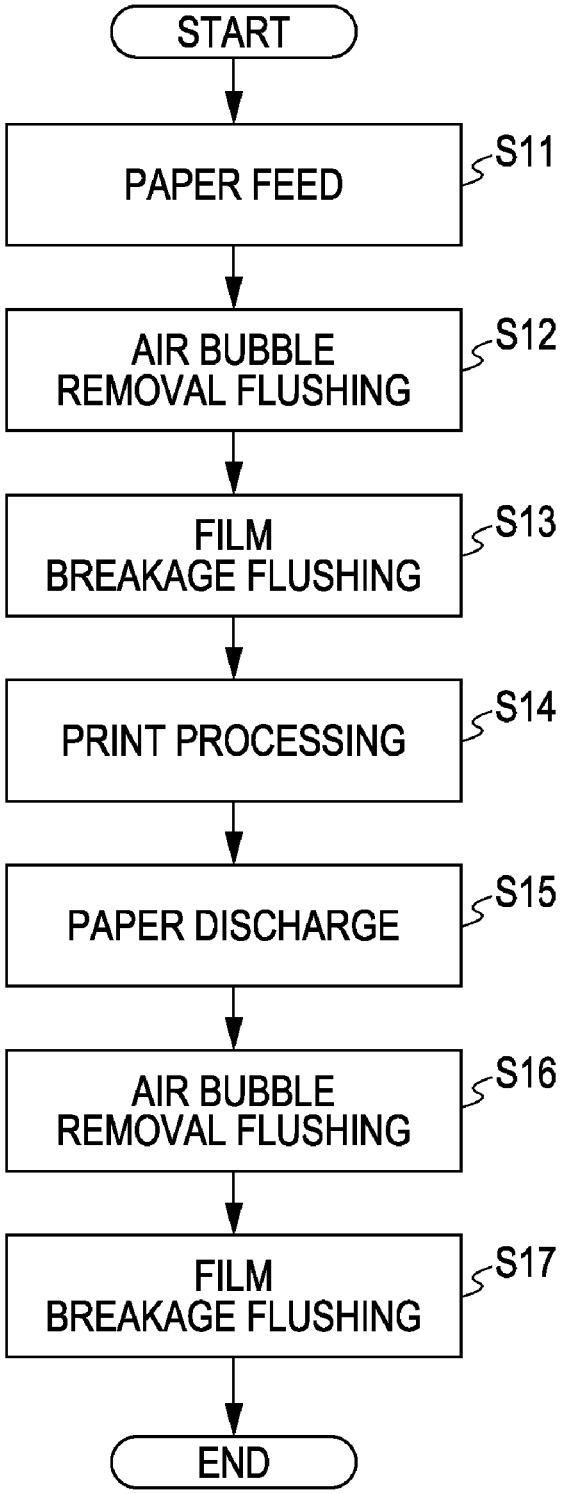
FIG. 8 is a flowchart explaining the flow of a paper feed and discharge maintenance process.

FIG. 8 is a flowchart explaining the flow of a paper feed and discharge maintenance process.

The paper feed and discharge maintenance process is a restoration process which is executed every time the recording medium such as the recording paper 9 is supplied onto the platen 11, as described above, and every time the recording medium is discharged from the platen 11. First, if the recording paper 9 is fed onto the platen 11 by the paper feed mechanism 52 (S11), the printer controller 35 controls the carriage movement mechanism 51, thereby moving the recording head 4 up to the top of the capping mechanism 16 or up to the top of the flushing point set at the end portion area of the platen 11. Then, the above-mentioned air bubble removal flushing process (the first maintenance process) is first executed (S12). As a result, the air bubbles in the ink flow path are discharged from the nozzle 32 along with ink. In addition, since the air bubble removal flushing process is performed in the same way by using the same driving pulse for air bubble removal flushing, DP1, as that in the air bubble removal flushing process in the periodic maintenance process described above, the explanation thereof is omitted.

If the air bubble removal flushing process is executed by a predetermined flushing segment, subsequently, a film breakage flushing process (one type of the second maintenance process) with the aim of breaking a meniscus changed into the form of a film mainly due to thickening is executed (S13). In the film breakage flushing process, for example, an ejection pulse which ejects a smaller ink droplet by using a greater force, for example, an ejection pulse for a small dot, is continuously applied to the piezoelectric element 24 as a driving pulse for film breakage flushing (one type of the second maintenance pulse), so that flushing which forcibly idle-ejects ink from the nozzle 32 to the flushing point is performed.

Figure 7:
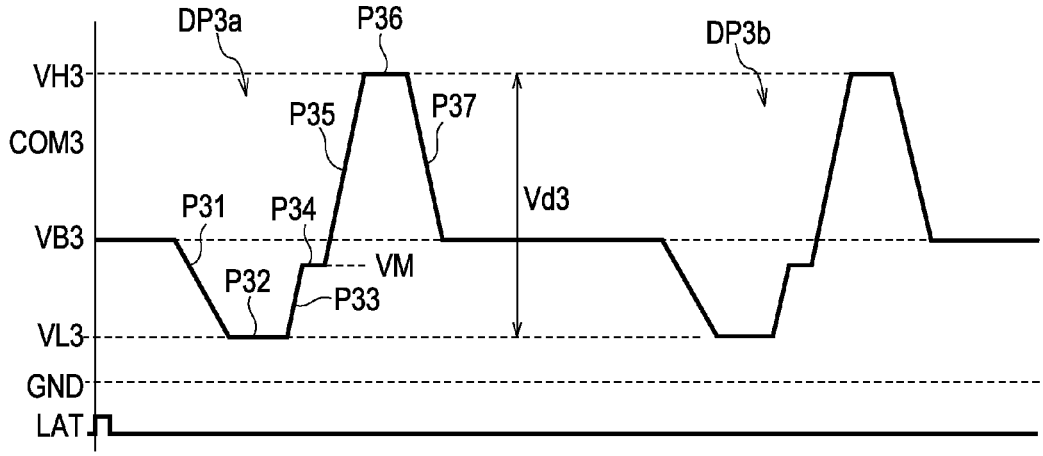
FIG. 7 is a diagram explaining a driving signal for film breakage flushing.

FIG. 7 is a diagram explaining a driving signal for film breakage flushing, COM3, which is used in the film breakage flushing process. The driving signal COM3 is constituted to include two driving pulses for film breakage flushing, DP3 (DP3*a* and DP3*b*), within a unit period which is separated by the LAT. A third reference electric potential VB3 of this driving signal is adjusted to be around 30% to 40% of an electric potential (a third contraction electric potential VH3) which corresponds to a state where the piezoelectric element 24 has been displaced to the pressure chamber 21 side, so that the pressure chamber 21 has contracted. In addition, a third expansion electric potential VL3 is an electric potential which corresponds to a state where the piezoelectric element 24 has been displaced to the opposite side to the pressure chamber 21, so that the pressure chamber 21 has expanded.

The driving pulse for film breakage flushing, DP3, (one type of a pulse for film breakage) is the ejection pulse for a small dot which is used in the print processing, as described above, and is constituted such that an ink droplet which is smaller in comparison with the above-mentioned flushing pulse for thickened ink discharge, DP2, is ejected by higher pressure. The driving pulse for film breakage flushing, DP3, is composed of an expansion element P31, in which an electric potential is changed to the minus side (in the first direction) from the third reference electric potential VB3 up to the third expansion electric potential VL3, thereby expanding the pressure chamber 21, an expansion maintaining element P32 (a holding element) which maintains the third expansion electric potential VL3 for a certain period of time, a first contraction element P33, in which the electric potential is changed to the plus side (in the second direction) from the third expansion electric potential VL3 up to an intermediate electric potential VM, thereby contracting the pressure chamber 21, an intermediate maintaining element P34 which maintains the intermediate electric potential VM for a certain period of time, a second contraction element P35, in which the electric potential is changed to the plus side from the intermediate electric potential VM up to the third contraction electric potential VH3, thereby contracting the pressure chamber 21, a contraction maintaining element P36 (a vibration suppression and holding element) which maintains the third contraction electric potential VH3 for a certain period of time, and a return element P37, in which the electric potential returns from the third contraction electric potential VH3 up to the third reference electric potential VB3. In other words, the driving pulse for film breakage flushing, DP3, is constituted by an ejection portion which is composed of waveform elements (the expansion element P31 to the second contraction element P35) for ejecting ink from the nozzle 32 and a vibration suppression portion which is composed of waveform elements (the contraction maintaining element P36 and the return element P37) for suppressing and stabilizing a residual vibration of the meniscus after ejection of ink by the ejection portion, similarly to the flushing pulse for thickened ink discharge, DP2.

Moreover, the driving pulse for film breakage flushing, DP3, has a feature in that the intermediate maintaining element P34 is provided which temporarily stops the contraction of the pressure chamber 21 at an intermediate volume corresponding to the intermediate electric potential VM in the process in which the pressure chamber 21 contracts from an expanded volume corresponding to the third expansion electric potential VL3 up to a contracted volume corresponding to the third contraction electric potential VH3. In this manner, by stopping the contraction of the pressure chamber 21 for a short time period during the process, the meniscus in the nozzle 32 is prevented from being pushed out at once, so that it is possible to reduce the amount of ink which is ejected from the nozzle 32. Also, a gradient (an amount of change in electric potential per unit time) of the second contraction element P35 is steeper than a gradient of the contraction element P23 of the flushing pulse for thickened ink discharge, DP2, so that a setting is made such that a change in pressure per unit time becomes larger. That is, the driving pulse for film breakage flushing, DP3, is constituted such that an ink droplet which is smaller in comparison with the flushing pulse for thickened ink discharge, DP2, is ejected by higher pressure. The amount of ink which is ejected in the film breakage flushing process is the smallest in comparison with other flushing processes. Also, the flying speed of ink which is ejected in the film breakage flushing process is slightly lower than the case of the above-mentioned air bubble removal flushing process and higher than the case of the thickened ink discharge flushing process. Also, timing of when the return element P37 of the driving pulse for film breakage flushing, DP3, is applied to the piezoelectric element 24 is adjusted such that the return element P37 is applied to the piezoelectric element 24 at a timing which cancels out residual vibration occurring within the pressure chamber 21 in accordance with an ink ejection operation by the contraction element P33.

If the driving pulse for film breakage flushing, DP3, is applied to the piezoelectric element 24, first, the piezoelectric element 24 is bent in a direction away from the pressure chamber 21 by the expansion element P31, so that the pressure chamber 21 expands from a reference volume corresponding to the third reference electric potential VB3 up to an expanded volume corresponding to the third expansion electric potential VL3. Through this expansion, the meniscus in the nozzle 32 is greatly drawn to the pressure chamber 21 side. Then, the expanded state of the pressure chamber 21 is maintained over a supply period of the expansion maintaining element P32. Thereafter, the first contraction element P33 is applied, so that the piezoelectric element 24 is bent to the pressure chamber 21 side. Due to the displacement of the piezoelectric element 24, the pressure chamber 21 contracts from the expanded volume up to the intermediate volume. Subsequently, the intermediate volume of the pressure chamber 21 is maintained over a supply period of the intermediate maintaining element P34 to the piezoelectric element 24. After the intermediate volume is maintained, the second contraction element P35 is applied, so that the piezoelectric element 24 is rapidly bent to the pressure chamber 21 side. Due to the displacement of the piezoelectric element 24, the pressure chamber 21 contracts from the intermediate volume up to the contracted volume. Ink in the pressure chamber 21 is pressurized due to the rapid contraction of the pressure chamber 21, so that ink is ejected from the nozzle 32. The contracted state of the pressure chamber 21 is maintained over a supply period of the contraction maintaining element P36. Then, the return element P37 is applied, so that the piezoelectric element 24 is bent in a direction away from the pressure chamber 21, whereby the pressure chamber 21 returns from the contracted volume up to the reference volume. As a result, a pressure oscillation which is different in phase from (preferably, has the opposite phase to) the residual vibration occurs, so that the residual vibration is reduced.

In the film breakage flushing process, the printer controller 35 repeatedly applies the flushing driving pulse for film breakage, DP3, which is generated from the driving signal generation circuit 43, to the piezoelectric element 24 by the prescribed flushing segment, thereby continuously executing the predetermined number of times of idle ejection of ink with respect to each nozzle 32. By performing such a film breakage flushing process, ink droplets which are smaller in comparison with the case of other maintenance processes are ejected one after another by higher pressure, so that even in a case where the meniscus is changed into the form of a film due to thickening, thereby blocking the nozzle 32, it is possible to break the meniscus by the ink droplets. Also, in the film breakage flushing process, since the vibration suppression portion is provided at the flushing driving pulse for film breakage, DP3, it is possible to quickly attenuate the residual vibration which occurs due to the flushing process, thereby stabilizing the meniscus.

If the air bubble removal flushing process and the film breakage flushing process are executed in sequence, the printer controller 35 executes the print processing which prints an image or the like on the recording paper 9 fed onto the platen 11 (S14). Then, the printer controller 35 controls the paper feed mechanism 52, thereby discharging the printed recording paper 9 from the top of the platen 11 to a downstream-side discharge opening (not shown) side (S15). If the printed recording paper 9 is discharged, the printer controller 35 executes the air bubble removal flushing process by a predetermined flushing segment (S16), and subsequently, executes the film breakage flushing process by a predetermined flushing segment (S17), in the same way as the time of paper feeding.

In this manner, by performing in combination the air bubble removal flushing process which is the first maintenance process and the thickened ink discharge flushing process which is the second maintenance process every time the recording medium such as the recording paper 9 is supplied to the platen 11 as a stage and every time the recording medium is discharged from the platen, it is possible to more effectively prevent poor ejection due to the thickening of ink or the air bubbles, and further, since the residual vibration is suppressed at the point of time when the film breakage flushing process has ended, it is possible to shorten the waiting time for controlling the residual vibration, so that it is possible to quickly transition to the next print processing.

In addition, in each embodiment described above, as a pressure generation section, the piezoelectric element 24 of a so-called flexural vibration type is illustrated. However, it is not limited to this, but, for example, it is also possible to adopt a piezoelectric element of a so-called longitudinal vibration type. In this case, with regard to the driving signal illustrated, the waveform thereof becomes a waveform in which a direction of a change in electric potential is inverted, that is, turned upside down.

Further, in the above, the ink jet type printer 1 which is one type of the liquid ejecting apparatus is taken and explained as an example. However, the invention can also be applied to other liquid ejecting apparatuses in which the retention of air bubbles becomes a problem. The invention can also be applied to, for example, a display manufacturing apparatus which manufactures a color filter of a liquid crystal display or the like, an electrode manufacturing apparatus which forms an electrode of an organic EL (Electro Luminescent) display, a FED (surface-emitting display), or the like, a chip manufacturing apparatus which manufactures a biochip (a biochemical element), or a micropipette which supplies a very small amount of sample solution in a precise amount.

What is claimed is:

1. A liquid ejecting apparatus comprising:

a liquid ejecting head which can eject liquid from a nozzle by driving a pressure generation section which changes a volume of a pressure chamber which communicates with the nozzle; and a control unit which generates a driving signal that includes a driving pulse that drives the pressure generation section, and applies the driving signal to the pressure generation section, thereby controlling the ejection of the liquid;

wherein the control unit is constituted so as to be able to generate a first pulse which performs a first maintenance process and a second pulse which performs a second maintenance process, the first pulse is composed of a series of waveform elements which give rise to a change in pressure within the pressure chamber so as to remove air bubbles in a liquid flow path of the liquid ejecting head, the second pulse is composed of waveform elements which includes an ejection portion and a vibration suppression portion so as to remove thickened liquid in the liquid ejecting head, and the control unit executes the second maintenance process by using the second pulse, after execution of the first maintenance process with use of the first pulse, in a maintenance process which restores ejection capability of the liquid ejecting head.

2. The liquid ejecting apparatus according to claim 1 wherein the control unit executes the second maintenance process every time a liquid ejection operation is performed by a predetermined unit with respect to a recording medium as an impacting target which is a target on which the liquid ejection operation is performed, and the second pulse in the second maintenance process is a pulse which discharges thickened liquid from the nozzle.

3. The liquid ejecting apparatus according to claim 2 wherein the control unit executes the second maintenance process every time a recording medium as an impacting target which is a target on which a liquid ejection operation is performed is supplied to the top of a stage which faces a nozzle face of the liquid ejecting head and every time the recording medium is discharged from the stage, and the second pulse in the second maintenance process is a pulse which breaks a meniscus changed into the form of a film by thickening.

4. A control method of a liquid ejecting apparatus which includes a liquid ejecting head that can eject liquid from a nozzle by driving a pressure generation section which changes a volume of a pressure chamber which communicates with the nozzle; and a control unit which generates a driving signal that includes a driving pulse that drives the pressure generation section, and applies the driving signal to the pressure generation section, thereby controlling the ejection of the liquid;

wherein the control unit is constituted so as to be able to generate a first pulse which performs a first maintenance process and a second pulse which performs a second maintenance process, the first pulse is composed of a series of waveform elements which give rise to a change in pressure within the pressure chamber so as to remove air bubbles in a liquid flow path of the liquid ejecting head, and the second pulse is composed of waveform elements which includes an ejection portion and a vibration suppression portion so as to remove thickened liquid in the liquid ejecting head, the method comprising:

executing the second maintenance process by using the second pulse, after execution of the first maintenance process, in the case of executing a maintenance process which restores ejection capability of the liquid ejecting head.

* * * * *